US009942954B2

(12) United States Patent
Neudorf et al.

(10) Patent No.: US 9,942,954 B2
(45) Date of Patent: Apr. 10, 2018

(54) METHOD AND SYSTEM FOR CONTROLLING SOLID STATE LIGHTING VIA DITHERING

(71) Applicant: Lumastream Canada ULC, Calgary (CA)

(72) Inventors: Jason Neudorf, Kitchener (CA); David Tikkanen, Waterloo (CA)

(73) Assignee: LUMASTREAM CANADA ULC, Waterloo, Ontario (CA)

( * ) Notice: Subject to any disclaimer, the term of this patent is extended or adjusted under 35 U.S.C. 154(b) by 0 days.

(21) Appl. No.: 15/212,798

(22) Filed: Jul. 18, 2016

(65) Prior Publication Data

US 2016/0360589 A1 Dec. 8, 2016

Related U.S. Application Data

(63) Continuation-in-part of application No. 13/640,440, filed as application No. PCT/CA2011/050298 on May 13, 2011, now Pat. No. 9,433,053.

(60) Provisional application No. 62/193,900, filed on Jul. 17, 2015, provisional application No. 61/334,736, filed on May 14, 2010.

(51) Int. Cl.
*H05B 33/08* (2006.01)

(52) U.S. Cl.
CPC ..... *H05B 33/0815* (2013.01); *H05B 33/086* (2013.01); *H05B 33/0851* (2013.01)

(58) Field of Classification Search
CPC ..... H05B 33/0815; H05B 33/0851
See application file for complete search history.

(56) References Cited

U.S. PATENT DOCUMENTS

| | | | |
|---|---|---|---|
| 5,184,114 | A | 2/1993 | Brown |
| 7,038,399 | B2 | 5/2006 | Lys et al. |
| 7,088,059 | B2 | 8/2006 | McKinney et al. |
| 7,177,166 | B1 | 2/2007 | Kris |
| 7,286,146 | B2 | 10/2007 | Goldschmidt et al. |
| 7,667,408 | B2 | 2/2010 | Melanson et al. |
| 8,000,359 | B2 | 8/2011 | Sasaki et al. |
| 8,278,840 | B2 | 10/2012 | Logiudice et al. |

(Continued)

FOREIGN PATENT DOCUMENTS

| | | |
|---|---|---|
| EP | 2071683 | 6/2009 |
| WO | 2003096761 | 11/2003 |

(Continued)

OTHER PUBLICATIONS

Canadian Intellectual Property Office As International Searching Authority, International Search Report and Written Opinion for PCT Patent App. No. CA2011/050298, dated Sep. 1, 2011.
United States Patent and Trademark Office, Office Action for U.S. Appl. No. 13/640,440, dated Dec. 19, 2013.
United States Patent and Trademark Office, Office Action for U.S. Appl. No. 13/640,440, dated Jul. 11, 2014.

(Continued)

*Primary Examiner* — Douglas W Owens
*Assistant Examiner* — Pedro C Fernandez
(74) *Attorney, Agent, or Firm* — Gowling WLG (Canada) LLP; Jeffrey Wong

(57) ABSTRACT

The disclosure is directed at a method and apparatus for controlling solid state lighting. The solid state lighting is controlled by the combination of a constant current reduction approach and a dithering approaching. The constant current reduction approach is used over a high light intensity range while the dithering approach is used over a low light intensity range.

19 Claims, 7 Drawing Sheets

(56) References Cited

U.S. PATENT DOCUMENTS

| | | | | |
|---|---|---|---|---|
| 8,299,987 | B2 | 10/2012 | Neudorf et al. | |
| 8,339,062 | B2 | 12/2012 | Cencur | |
| 8,362,706 | B1 | 1/2013 | Godbole | |
| 8,441,202 | B2 | 5/2013 | Wilson | |
| 8,525,446 | B2 | 9/2013 | Tikkanen et al. | |
| 8,957,601 | B2 | 2/2015 | Tikkanen et al. | |
| 9,066,381 | B2 | 6/2015 | Valois | |
| 2011/0169426 | A1 | 7/2011 | Sadwick et al. | |
| 2011/0204820 | A1* | 8/2011 | Tikkanen ..... | H05B 33/0815 315/294 |
| 2013/0088171 | A1* | 4/2013 | Fensore ..... | H05B 33/0818 315/307 |
| 2013/0229215 | A1 | 9/2013 | Sadwick | |

FOREIGN PATENT DOCUMENTS

| | | |
|---|---|---|
| WO | 2011140660 | 11/2011 |
| WO | 2013052941 | 4/2013 |

OTHER PUBLICATIONS

United States Patent and Trademark Office, Office Action for U.S. Appl. No. 13/640,440, dated Feb. 25, 2015.

United States Patent and Trademark Office, Office Action for U.S. Appl. No. 13/640,440, dated Nov. 5, 2015.

United States Patent and Trademark Office, Notice of Allowance for U.S. Appl. No. 13/640,440, dated Jun. 6, 2016.

Canadian Intellectual Property Office As International Searching Authority, International Search Report and Written Opinion for PCT Patent App. No. CA2016/050843, dated Oct. 18, 2016.

* cited by examiner

| Dim Command Level | Desired Light Intensity | Attenuation Number | OT1 (us) | P1 (us) | OT2 (us) | P2 (us) | Dithered Weighting Band #1 | Dithered Weighting Band #2 | On Time Peak Constant Current | Effective duty cycle with both dithered freq bands and applied weighting | Calculated Output Light Intensity |
|---|---|---|---|---|---|---|---|---|---|---|---|
| 130 | 6.04% | 32000 | 84 | 462 | 70 | 386 | 7 | 9 | 33.3% | 0.182 | 6.05% |
| | 6.00% | 32064 | 84 | 466 | 70 | 388 | 7 | 9 | 33.3% | 0.180 | 6.01% |
| | 5.97% | 32128 | 84 | 468 | 70 | 390 | 6 | 10 | 33.3% | 0.179 | 5.98% |
| | 5.94% | 32192 | 84 | 470 | 70 | 392 | 6 | 10 | 33.3% | 0.179 | 5.95% |
| 129 | 5.90% | 32256 | 84 | 474 | 70 | 394 | 5 | 11 | 33.3% | 0.178 | 5.92% |
| | 5.87% | 32320 | 84 | 476 | 70 | 396 | 5 | 11 | 33.3% | 0.177 | 5.89% |
| | 5.84% | 32384 | 84 | 478 | 70 | 398 | 4 | 12 | 33.3% | 0.176 | 5.86% |
| | 5.81% | 32448 | 84 | 482 | 70 | 402 | 4 | 12 | 33.3% | 0.174 | 5.81% |
| 128 | 5.77% | 32512 | 84 | 484 | 70 | 404 | 3 | 13 | 33.3% | 0.173 | 5.78% |
| | 5.74% | 32576 | 84 | 486 | 70 | 406 | 3 | 13 | 33.3% | 0.173 | 5.75% |
| | 5.71% | 32640 | 84 | 490 | 70 | 408 | 2 | 14 | 33.3% | 0.172 | 5.72% |
| | 5.68% | 32704 | 84 | 492 | 70 | 410 | 2 | 14 | 33.3% | 0.171 | 5.69% |
| 127 | 5.64% | 32768 | 84 | 496 | 70 | 412 | 1 | 15 | 33.3% | 0.170 | 5.66% |
| | 5.61% | 32832 | 84 | 498 | 70 | 414 | 1 | 15 | 33.3% | 0.169 | 5.64% |
| | 5.58% | 32896 | 84 | 500 | 70 | 418 | 0 | 16 | 33.3% | 0.167 | 5.58% |
| | 5.55% | 32960 | 84 | 504 | 70 | 420 | 0 | 16 | 33.3% | 0.167 | 5.56% |
| 126 | 5.52% | 33024 | 70 | 422 | 58 | 350 | 15 | 1 | 33.3% | 0.166 | 5.53% |
| | 5.49% | 33088 | 70 | 424 | 58 | 352 | 15 | 1 | 33.3% | 0.165 | 5.50% |
| | 5.46% | 33152 | 70 | 426 | 58 | 354 | 14 | 2 | 33.3% | 0.164 | 5.48% |
| | 5.43% | 33216 | 70 | 430 | 58 | 356 | 14 | 2 | 33.3% | 0.163 | 5.43% |
| 125 | 5.39% | 33280 | 70 | 432 | 58 | 358 | 13 | 3 | 33.3% | 0.162 | 5.40% |
| | 5.37% | 33344 | 70 | 434 | 58 | 360 | 13 | 3 | 33.3% | 0.161 | 5.38% |
| | 5.34% | 33408 | 70 | 436 | 58 | 362 | 12 | 4 | 33.3% | 0.160 | 5.35% |
| | 5.30% | 33472 | 70 | 438 | 58 | 364 | 12 | 4 | 33.3% | 0.160 | 5.32% |
| 124 | 5.27% | 33536 | 70 | 442 | 58 | 366 | 11 | 5 | 33.3% | 0.158 | 5.28% |
| | 5.25% | 33600 | 70 | 444 | 58 | 368 | 11 | 5 | 33.3% | 0.158 | 5.25% |
| | 5.22% | 33664 | 70 | 446 | 58 | 370 | 10 | 6 | 33.3% | 0.157 | 5.23% |
| | 5.19% | 33728 | 70 | 448 | 58 | 372 | 10 | 6 | 33.3% | 0.156 | 5.20% |
| 123 | 5.16% | 33792 | 70 | 452 | 58 | 374 | 9 | 7 | 33.3% | 0.155 | 5.17% |
| | 5.13% | 33856 | 70 | 454 | 58 | 376 | 9 | 7 | 33.3% | 0.154 | 5.14% |
| | 5.10% | 33920 | 70 | 456 | 58 | 378 | 8 | 8 | 33.3% | 0.153 | 5.12% |
| | 5.07% | 33984 | 70 | 460 | 58 | 380 | 8 | 8 | 33.3% | 0.152 | 5.08% |
| 122 | 5.04% | 34048 | 70 | 462 | 58 | 382 | 7 | 9 | 33.3% | 0.152 | 5.06% |
| | 5.01% | 34112 | 70 | 464 | 58 | 384 | 7 | 9 | 33.3% | 0.151 | 5.03% |
| | 4.99% | 34176 | 70 | 466 | 58 | 386 | 6 | 10 | 33.3% | 0.150 | 5.01% |
| | 4.96% | 34240 | 70 | 470 | 58 | 388 | 6 | 10 | 33.3% | 0.149 | 4.98% |
| 121 | 4.93% | 34304 | 70 | 472 | 58 | 392 | 5 | 11 | 33.3% | 0.148 | 4.94% |

FIGURE 3

METHOD AND SYSTEM FOR CONTROLLING SOLID STATE LIGHTING VIA DITHERING

CROSS REFERENCE TO OTHER APPLICATIONS

This application is a continuation-in-part of U.S. patent application Ser. No. 13/640,440, filed Oct. 10, 2012, which is a national stage filing under 35 U.S.C. 371 of International Patent Application PCT/CA2011/050298, filed May 13, 2011, which claims the benefit of U.S. Patent Application No. 61/334,736, filed May 14, 2010, the contents of all of which are incorporated herein by reference. This application also claims the benefit of U.S. Patent Application No. 62/193,900, filed Jul. 17, 2015, the contents of which are incorporated herein by reference.

FIELD OF THE DISCLOSURE

This disclosure is directed generally at lighting and more specifically to a method and system for controlling solid state lighting via dithering.

BACKGROUND OF THE DISCLOSURE

A solid state lighting device (SSL) is a semiconductor light source commonly used in general illumination applications. Examples of SSL devices include light emitting diodes (LEDs), Organic LEDs (OLEDs), and power LEDs (PLEDs). In illuminated areas that require video recording applications, there is a need to minimize the effects of video artifacts to maintain the recorded image quality as well as provide a wide dynamic range capability below 1%.

In some current systems, a pulsing current method such as, but not limited, to pulse width modulation or variable frequency modulation is used to control the LEDs. This pulsing current method varies the duty cycle and correspondingly the average current to vary the light intensity through a SSL/LED device where the light output is proportional to average current. At low pulse current dimming frequencies, noticeable scroll lines or flickering may be visible in the recorded images.

Therefore, there is provided a novel method and system for controlling solid state lighting via dithering.

SUMMARY OF THE DISCLOSURE

The disclosure is directed at a system and method of controlling solid state lighting devices (SSLs) such as light emitting diodes (LEDs).

In one aspect, there is provided a method for controlling solid state lighting including receiving dimming or light intensity information; translating dimming or light intensity information into LED control information; and transmitting the LED control information to a current source. The LED control information includes constant current reduction control information for a high light intensity range and dithering control information for a low light intensity range.

In another aspect, the high light intensity range is between about 10% to 100% light intensity. In a further aspect, the low light intensity range is less than 10% light intensity. Furthermore, the low light intensity range may be between 10% and 0.6 light intensity. In yet another embodiment, a transition point between the high light intensity range and the low light intensity is configurable.

In another aspect of the disclosure, there is provided a method for controlling solid state lighting including implementing a dithering approach between variable frequency bands over a low light intensity range; and implementing a constant current reduction method over a high light intensity range; whereby current is reduced without interruption over the high light intensity range.

In another aspect, the dithering approach includes maintaining a constant peak current while dithering between two variable frequency bands and corresponding variable periods with at least two distinct values of on time. The constant peak current is reduced from a value established at a full light intensity level by the constant current reduction method. In yet a further aspect, the constant current reduction method includes maintaining a digital signal in a constant signal state such that the constant signal state is either active high or active low depending on digital logic implemented for the digital signal.

In yet a further aspect, there is provided an apparatus for controlling solid state lighting including an interface for receiving command signals from an external source; a controller for receiving the command signals and translating the command signals to LED control information, the LED control information implementing a constant current reduction approach over a high light intensity range and a dithering approach over a low light intensity range; and a set of signal generators for delivering the LED control information to a set of current sources to deliver power to the solid state lighting based on the LED control information.

In an aspect, the external source is an external transmitter or a data source. In another aspect, the apparatus further includes a set of current sources. The set of current sources including a buck circuit power conversion stage with hysteretic control.

BRIEF DESCRIPTION OF THE DRAWINGS

Embodiments of the present disclosure will now be described, by way of example only, with reference to the attached Figures, wherein:

FIG. 3 is a table illustrating dithered variable frequency values for a range of dimming command levels;

DETAILED DESCRIPTION OF THE DISCLOSURE

Figure 1:
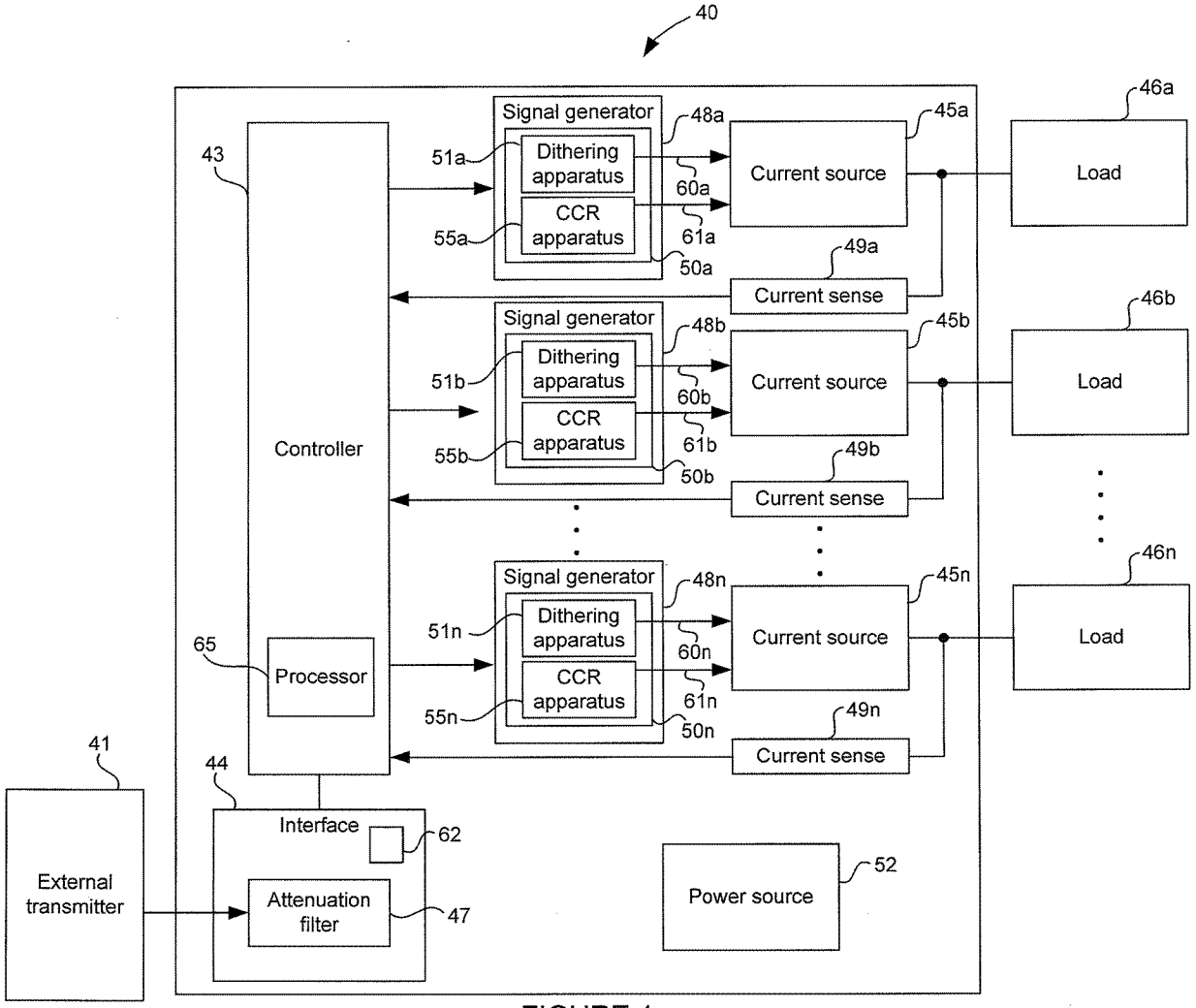
FIG. 1 is a schematic diagram of an embodiment of apparatus for controlling light emitting diodes (LEDs)

The present disclosure is directed at a system and method of controlling solid state lighting devices (SSLs) such as light emitting diodes (LEDs). In one embodiment, the LEDs are preferably dimmed or varied in light intensity to mitigate the effects of perceptible flicker and mitigate the effects of video recording artifacts. In another embodiment, the system and method control the SSLs or LEDs over a wide dynamic light intensity range or contrast ratio. In a preferred embodiment, this wide dynamic light intensity range includes a range below 1% light intensity. While much of this disclosure refers to LEDs, other SSL devices may also be used without loss of generality.

There are at least two distinct stages, or ranges, for dimming or color changing LEDs to achieve a wide dynamic dimming range.

In one embodiment of the disclosure, for a first range of light intensities, the present disclosure implements a constant current reduction method, approach, or solution. This first range of light intensities may be seen as a high light intensity range. For a second range of light intensities, the present disclosure implements a dithering approach or method. This second range of light intensities may be seen as a low intensity range. In a preferred embodiment, the dithering approach dithers between two or more variable frequency bands. Each variable frequency band has a distinct on time, and variable period and multiple variable frequency bands are utilized to reduce the frequency range of the current pulse provided to a LED load over the dimming range. In another embodiment, there may be a third range, which may be seen as a very low light intensity range.

Dithering between variable frequency bands while changing light intensity commands mitigates the impact of deviations in average current supplied to the LED load during transitions to different on-times. This reduces the likelihood of a perceptible jump in light intensity.

By dithering between different variable frequency bands, average current to the load is encoded within the five variables of a first on-time and off-time pair (on1, off1) and a second on-time and off-time pair (on2, off2) as well as a ratio or weighting (n) between the pairs.

In order to minimize or reduce flicker when ramping over a wide dynamic dimming range or contrast ratio from less than 1% to a full intensity of 100%, it is preferred that each change in intensity be significantly less than a 1% change from the previous level.

Furthermore, for applications requiring a wide dynamic dimming range of less than 1% to 100% full intensity, a pulse current including a very low duty cycle of on time versus period may be required.

Typical digital video technologies have various frame rates including 24, 25, 30, or 60 frames per second (fps). Multiples of these frame rates as high as 240 fps or 300 fps are now also available in high end video recording applications. Beat frequencies are generated by the difference in the frame rate of a video recording device and the frequency of the dimming current pulse. These beat frequencies may result in noticeable scroll lines and flickering in video recorded images or distortion of recoded video images, referred to as video artifacts.

To alleviate these video artifacts, it is beneficial to have the pulse current frequencies significantly greater than the frame rates of a video recording device such as frequencies preferably greater than 1200 Hz.

The implementation of a combined constant current reduction approach and a dithered approach includes providing a weighted transition between variable frequency bands. Advantages include, but are not limited to, providing a wide dynamic dimming range from 100% to less than 1% light intensity, reducing or minimizing visually perceptible flicker while dimming, and improving the quality of video recorded images by reducing or minimizing flicker and scroll lines in the images to reduce or minimize video artifacts.

The advantage of implementing a constant current reduction method for dimming is that it does not pulse current through a SSL/LED device and hence there is no perceptible degradation of the video recording quality due to scroll lines or flickering. However, at lower light intensity ranges, there is a noticeable color shift of the light output from a SSL/LED device when using the constant current reduction approach. Therefore, a dithering approach is used for the lower light intensity levels.

The implementation of a constant current reduction method over a high light intensity range also reduces the range of frequencies required using variable frequency bands over a lower portion of the intensity range. In this instance, it is desirable to maintain the range of frequencies to a narrow range such that electromagnetic compatibility issues are mitigated at high frequencies and video recording quality is maintained at lower frequencies.

Figure 2:
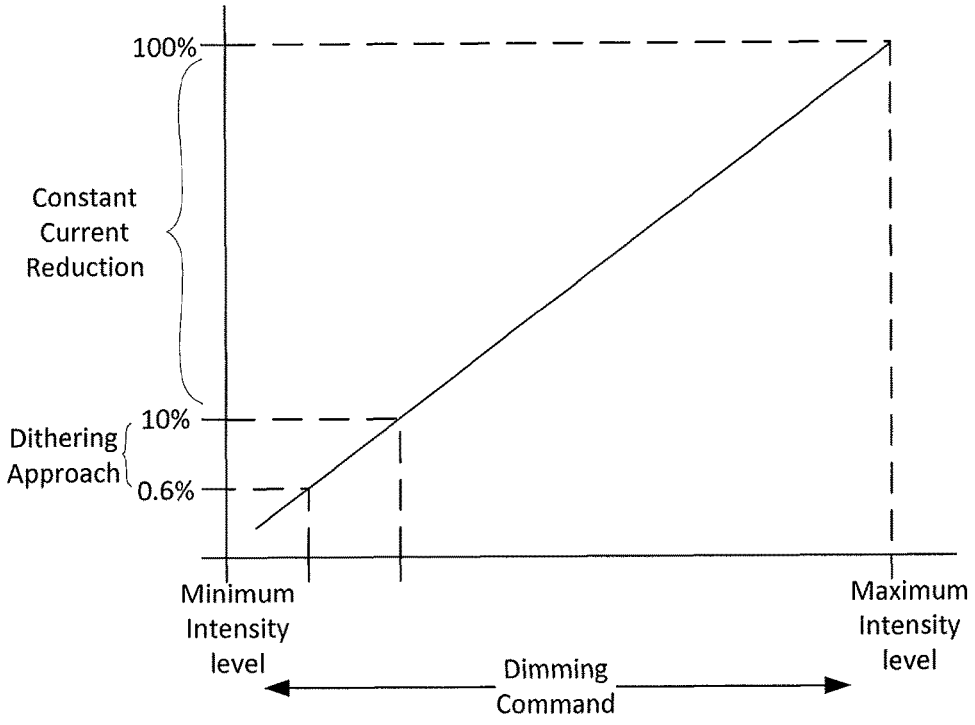
FIG. 2 shows an example graph for a set of light intensity ranges.

FIG. 2 is a graph showing how a constant current reduction approach and a dithering approach can be combined with respect to a dimming command between minimum (or low) and maximum (or high) intensity levels. In this example graph, light intensity is expressed as a percentage versus a dimming command range from a minimum level to a maximum level.

The graph of FIG. 2 shows a wide dynamic dimming range of less than 1% to 100% full light intensity on the Y-axis. As shown, in one embodiment, the constant current reduction method is used to control the SSL device over a high light intensity range (such as from about 10% to 100% light intensity while the dithering approach is used to control the SSL device over a low light intensity range (such as from about 0.6% to 10% light intensity). This combined approach may be used to reduce or minimize video recording artifacts or flicker.

In other words, a dithering approach is shown implemented over a lower portion of a light intensity range with corresponding dimming command levels and a constant current reduction method is implemented over a higher portion, or range, of light intensity levels with corresponding dimming command levels.

In operation, the constant peak current value is reduced from the value established at the 100% intensity level via the constant current reduction method implemented over the high intensity range. For the low light intensity range, the dithering approach preferably maintains a constant peak current value while dithering between two variable frequency bands and corresponding variable periods, with at least two distinct values of on time. The peak current is maintained at a constant value for the dithering approach implementation over the low intensity range.

A first embodiment of apparatus for implementing the combined constant current reduction and dithered approach for controlling SSL is shown with respect to the block diagram of FIG. 1.

The apparatus 40 includes an interface 44 which includes an attenuation filter 47.

The interface 44 receives signals, seen as external control information or command signals, from an external transmitter 41 or a data source that generates the dimming or color changing command signals. Communication between the external transmitter 41 and the interface 44 may be via wired or wireless communication using any known communication protocol. During this communication, the external transmitter 41 may provide one or more command signals depending on the type of control desired.

In one embodiment, the attenuation filter 47 is preferably a low pass, digital filter that generates intermediate intensity values between dimming or color changing command signals received from the external transmitter 41. The attenuation filter 47 may be an optional feature depending on the resolution of the intensity command signals provided by the external transmitter or data source 41.

The external transmitter 41 or data source may be a DMX512A transmitter that generates packets of digital data based on the DMX512A protocol over a RS485 physical layer which is a standard that defines the electrical characteristics of drivers and receivers in a balanced digital multipoint system. This physical layer is also known as EIA-485 or TIA/EIA-485. The external transmitter 41 may also be a 0-10 Vdc Analog Control transmitter implemented by various protocols such as, but not limited to, ESTA E1.3-2001 "Lighting Control Systems 0-10 Vdc Analog Control Specification" for entertainment applications or IEC60929 "AC Supplied Electronic Ballasts for Tubular Lamps" for commercial lighting applications. Additional communication protocols may also include RDM (Remote Device Management) and DALI (Digital Addressable Lighting Interface). RDM requirements are defined in ANSI E1.20; Remote Device Management over DMX512 Networks. DALI requirements are defined in standards IEC 62386-101; System General Requirements, IEC 62386-102; General Requirements-Control Gear, and IEC 62386-207; Particular Requirements for Control Gear-LED Modules.

The apparatus 40 further includes a controller 43, for controlling a plurality of loads, such as LED loads 46. The controller 43 is in communication with the interface 44 to receive the command signals supplied by the external transmitter 41. The interface 44 may process the command signal or signals from the external transmitter 41 prior to its transmission to the controller 43 or the interface 44 may simply transmit the command signal to the controller 43 where the command signal is then processed.

The controller 43 includes a processor, or processing unit, 65 which is used to translate the command signal or signals received from the external transmitter into LED/load control information that is then processed and supplied to the signal generators 48, to which the controller 43 is connected. Depending on the command signal, the LED control information may be transmitted to the dithering apparatus 51 or the CCR apparatus 55 for dithering variable frequency operation and CCR (constant current reduction) operation, respectively.

As shown, the plurality of signal generators 48 are individually denoted as 48*a* to 48*n*, however, it should be noted that the use of "n" does not mean there are only fourteen signal generators, but "n" may represent any value. Within each of the signal generators 48 is a processor, mechanism, or apparatus 50 including a dithering apparatus 51 and a constant current reduction (CCR) apparatus 55. In one embodiment, the apparatus 50 may include a programmable logic device, such as a complex programmable logic device (CPLD) and a digital-to-analog converter (DAC). The dithering apparatus 51 and the CCR apparatus 55 are used to generate digital and analog signals representing LED control information for the current source, as will be discussed below.

In one embodiment, the CCR apparatus 55 generates an analog CCR control signal which is transmitted to the current source. The analog CCR control signal is generated based on the LED control information received from the controller. In one embodiment, a one-bit DAC algorithm generates a pulse density modulated signal that is filtered by an active filter such as one using a Sallen Key filter topology. The output of the active filter generates a DC voltage level 61 that is compared to the sensed input current 49. A comparator circuit located within the current source 45 and configured for hysteresis, receives the DC voltage level 61 on the positive input pin and receives the feedback current via a current sense on the negative pin of the comparator. The output of the comparator drives a MOSFET switch within a buck power conversion circuit in the current source 45.

In another embodiment, the dithering apparatus, which may be seen as a dithering function, generates a dithering control signal such as via an algorithm for its associated current source.

In a preferred embodiment, the individual signal generators 48 receive LED control information from the controller 43, such as in the form of two pairs of on and off times (on1, off1) and (on2, off2), plus a ratio between them (typically implemented out of 16, where the ratio number is a number from 1 to 16). Dithering is achieved by using (on1, off1)x/16 of the time, and (on2, off2) is used 1−(x/16) of the time where x is the ratio number.

By dithering, the signal generator 48 alternates between one on/off time pair and the next according to the ratio in a pre-defined sequence, with the order of the sequence being arbitrary. For example, if the first on/off time pair (on1, off1) is used 5/16 of the time and the second on/off time pair (on2, off2) is used 11/16 of the time, a sample sequence may be 1111122222222222, or 1112222211222222, or 1221222122122122 (where the digit 1 represents the first on/off time pair and the digit 2 represents the second on/off time pair). The sequence repeats quickly such that the change in intensity during the sequence (due to error) from on time 1 to on time 2 may not be noticed. Therefore, if the desired intensity for the LED is a value between (on1, off1) and (on2, off2) but closer to (on1, off1), the weighting, or ratio, will be selected so that the (on1, off1) weighting is higher than the (on2, off2) weighting for selected command levels.

In terms of the selected length of sequence, the length of sequence should be selected so that the total time taken by an entire sequence is small enough that a human eye will not notice any flicker. Suppose the sequence is 1111111211111111, with "1" digits representing the (on1/off1) pair, and "2" representing the (on2/off2) pair. If the (on2, off2) pair has a +5% error, and the (on1, off1) pair has a −5% error. There is a 10% difference in intensity. With the (on1, off1) and (on2, off2) pairs at a minimum of about 2 kHz (as in one embodiment), the entire sequence repeats at 2 kHz/16=125 Hz or so. Therefore, there is a 10% change in intensity (flicker) throughout the sequence, but this flicker is at >100 Hz, so it is not noticeable. Empirically, at 20 Hz a difference may be noticeable, at 100 Hz it will not, and in-between, different people may notice to some extent or another.

Alternatively, if a length of sequence of 128 is selected with the previous (on1, off1) and (on2, off2) pairs, with a weight of 127/128 for (on1, off1) and 1/128 for (on2, off2), the sequence would take 1/15th of a second (64 ms) to complete, or 15 Hz. Every 15th of a second, the intensity would rise and fall by 10%. This would be immediately noticeable as flicker.

Each signal generator is connected to a current source from a set of current sources 45, individually denoted as 45*a* to 45*n*. In the current embodiment, the signal generators and the current sources 45 are in a one-to-one relationship, however it is envisioned that a single signal generator could control multiple current sources. The current sources 45 preferably include ancillary circuitry for operation such as a buck circuit power conversion stage with hysteretic control. The buck conversion topology or step down DC/DC power converter also includes a high side current sense 49 connected to the positive voltage rail of the DC/DC power conversion circuit (not shown).

The output of each current source 45 is connected to an associated external load 46 (seen as loads 46*a* to 46*n*) and an associated current sense 49 (individually denoted as 49*a* to 49*n*). Each current sense 49 is also connected to the controller 43 and forms part of a digital control feedback loop between the controller 43, the signal generator, the current source and the current sense.

In a further embodiment, the current sense may be removed and the current source may include a linear regulator rather than a switch mode converter configured as a current source.

In another alternative embodiment, each of the current sources may be contained within a remote mounted module or may be a monolithic component of the apparatus. It is understood that the current sources may comprise many alternate topologies so long as they can be turned "on" and "off" through a digital signal. Furthermore, the feedback loop may be removed if the current provided by the current source is the desired peak current for a given application of LEDs.

In yet a further embodiment, the controller 43 and one or more signal generators 48 are located within a microcontroller. A power supply 52 is also located within the apparatus to provide the necessary power for operation of the apparatus.

Figure 7:
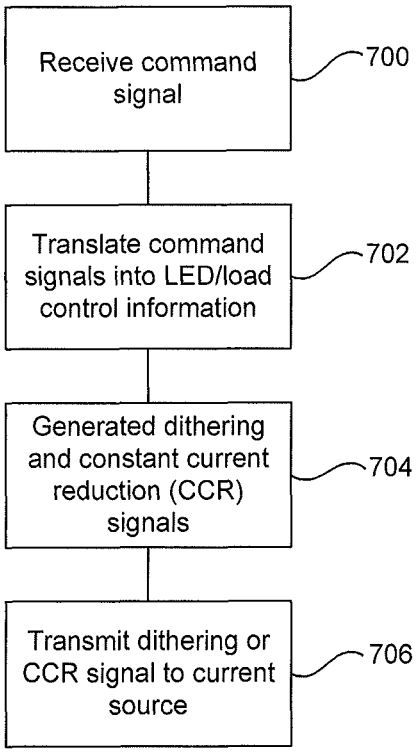
FIG. 7 is a flowchart outlining another method of controlling LEDs

In operation, such as schematically shown in FIG. 7, a command signal, or command signals, is received from an external transmitter (700). In the case of the external transmitter 41 comprising a DMX512A source, the controller 43 receives dimming or color mixing command signals preferably in the form of a serial data stream via the communication interface 44 and attenuation filter 47.

Alternatively, if the external transmitter 41 is a 0-10 Vdc analog data source, the communication interface 44 converts the 0-10 Vdc analog signal to a serial digital data stream before transmitting this serial digital data stream to the controller 43. In this embodiment, the communication interface preferably comprises an analog-to-digital (A/D) converter 62.

After receiving the command signals, the controller translates the command signals into LED/load control information for use by the signal generator(s) (702). The LED/load control information includes dithering control information and CCR control information. The dithering control information is used for control of the load over a low light intensity range while the CCR control information is used for control of the load over a high light intensity range. Other embodiments may use other data transmission techniques from communication interface 44 to controller 43 such as parallel transmission to provide data to the controller 43. Other embodiments may also use wireless data transmission techniques from the external transmitter 41 to the communication interface 44 such as Zigbee or Bluetooth.

Based on the LED/load control information received from the controller, each signal generator 48 typically generates either a dithering control signal or a CCR control signal in the form of a digital signal 60 and an analog signal 61 (704). In other words, the dithering control information and/or the CCR control information may be transmitted from the controller such that the signal generator generates electrical (such as the digital and analog signals) equivalents, signals or parameters of the dithering and/or CCR control information from the processor within the controller. In the preferred embodiment, the dithering control signal is used for controlling the load in a low light intensity range while the CCR control signal is used for controlling the load in a high light intensity range.

The dithering control signal and the CCR control signal are then transmitted to the current source 45 (706). The digital and analog signals deliver instructions to the current source to power the loads. These signals may be generated via a digital control algorithm and 1 Bit algorithm respectively such as described in US Patent Publication 2007/0103086, which is hereby incorporated by reference. In one embodiment, the signal generators 45 receive the LED/load control information and translate this information into the dithering control signal and/or or the constant current control signal (depending on the command signal) which is transmitted via a digital data line 60 and an analog data line 61 respectively to the current source 45.

The current source 45, after receiving the dithering or CCR control signal provides current to its associated load 46 based on these signals.

In the low light intensity range, the output current is provided while maintaining peak current supplied to the load at a constant low level and dithering between two variable frequency bands and corresponding variable periods, with at least two distinct values of on time. This results in LED average current to the load being encoded within the five variables of a first on-time and off-time pair (on1, off1) and a second on-time and off-time pair (on2, off2) as well as a ratio or weighting (n) between the pairs.

Neither the dimming frequency at which pulsed current is provided to the load nor the time period for which it is operating is a constant over the dynamic range of light intensity. As such, the method outlined in FIG. 5 allows for maintenance of the output dimming frequency current within a narrow dynamic range. It will be further understood that specifying any two of on-time, off-time and period is mathematically equivalent, and that period and frequency are inversely related, and thus, it is equivalent to specify, for example, on-time and period or off-time and frequency in place of on-time and off-time.

In another embodiment of operation, over the high light intensity range, the constant current reduction method is implemented by maintaining the digital signal 60 in a constant signal state. The constant signal state may be either active high or active low depending on the digital logic implemented for the digital signal 60. The analog control signal 61 is varied to adjust the direct current (DC) generated by the current source 45 to provide current to its associated load 46.

Over the low light intensity range, the dithering information, or dithering control signal, comprised of on time and off time pairs and weighting between these pairs, is transmitted via the digital control signal 60 to the current source 45. The analog signal 61 is maintained at a constant value and transmitted to the current source 45. In this instance, the value of the analog control signal 61 has been reduced by an amount corresponding to a reduction in light intensity from about 100% to about 10%. At about the 10% transition point as shown in FIG. 2, the analog control signal 61 is then maintained at a constant value for the light intensity range from about 10% to about 0.6%.

It is understood that there may be some ripple current superimposed on the peak on time current supplied by the current source to the LED load 46 due to switch mode function of the current source.

For example, the reduction of light intensity from 100% to 10% can be represented as a change in direct current from 700 mA to 70 mA supplied to an LED load. The 700 mA current value represents the set point current for a particular LED load based on a manufacturer's recommended rating at full light intensity. Within the 10% to 0.6% light intensity range, the peak current supplied to the LED load is held constant at 70 mA and a dithering approach between variable frequency bands is implemented to further change the average current through the LED load.

The transition point between the constant current reduction approach to the dithering approach may be configured at any point between 0% to 100% of the light intensity range depending on the characteristics of a particular LED load and/or current source 45 electrical design characteristics. In other words, various LED loads from various manufacturers may have a noticeable shift in correlated color temperature (CCT) at different light intensities such as at 10% or at 4%. Similarly, the current source 45 may have noise levels in the circuit that determine a practical transition point for adequate dimming performance.

A firmware implementation of the dimming algorithm including a combined constant current reduction method and pulsing method can include an option to configure at least one parameter in the firmware to adjust the transition point between a constant current reduction method and a dithering method to mitigate observable CCT shift.

In order to increase the dimming range to below 1% of light intensity, it is preferred to extend the range of the constant current reduction method to as low an intensity level as possible before using a dithering method. It is also understood that the minimum intensity level is not limited to 0.6% but may be any level below 1%.

For the low intensity range using the dithering approach, the variable frequency bands are preferably in the frequency range of 2.4 Khz to 3 Khz and the on time pulse duration is between the range of 22 μs and 342 μs.

In a further implementation detail, for the set of light intensity ranges, a third intensity range may be implemented to further increase the dynamic light intensity range below 1%. The third intensity range may include a pure variable frequency method with constant on time over a range from about 0.6% to about 0.2%. The pure variable frequency method for the third intensity range, preferably, has a minimum, or low, frequency of 1200 Hz.

Furthermore, in another embodiment of dithering, the dithering function is implemented via an algorithm that may also be applied to other control methods other than hysteretic control where errors are generated between actual and calculated current pulse widths supplied to a load.

In another embodiment of operation, as referenced in FIG. 1, the attenuation filter 47 receives a dimming or color changing command signal from the external transmitter 41 (via the interface 44) and generates an output number from 0 to 65280 which is transmitted to the controller 43 in the form of the digital data stream.

In one embodiment, the attenuation filter is an inverting, low pass, digital filter with a time constant determined to be aesthetically pleasing. It is understood that other low-pass filters might be used. In one example embodiment, implementation may be achieved as described below and represented by the following formula:

$$a(t)=a(t-1)+(255-\text{dimlevel}(t))\times 4-(a(t-1)/16)$$

where:

a(t) the current output filter attenuation value represented by a number from 0 to 65280; a(t−1) is the previous output filter attenuation value represented by a number from 0 to 65280; and dimlevel(t) is a current value from 0 to 255 received from the external transmitter based on a 8 bit dimming or color changing command such as from a DMX512A source or a value from 0 to 255 generated by the interface based on the digital to analog conversion of an analog 0-10 Vdc signal received from external transmitter.

The gain is −256 times the 'dim level' and the output values of a(t) are generated about 122 times per second. Conceptually, the attenuation filter value a(t) is the inverse of the dimlevel(t) and is at its maximum value when dimlevel(t) is at a minimum value and a(t) is at its minimum value when dimlevel(t) is at its maximum.

Turning back to FIG. 2, for high light intensity levels typically greater than 10%, an example calculation for CCR control information within the LED control information is outlined below. The controller 43 computes the desired current as follows:

$$I_{desired}=\text{MaxCurrent}\times C^{-a(t)/65280}$$

where $I_{desired}$ is a set point current, MaxCurrent is the maximum current at full light intensity, C is the contrast ratio defined as the ratio between the highest light output to the lowest light output and a(t) is the current output filter attenuation value represented by a number from 0 to 65280

For light intensity levels typically less than 10% as shown in FIG. 2, also seen as dithered variable frequency operation, and corresponding current pulses supplied by the current source to the load, in one example, the LED control information (seen as dithering control information) for the dithering control signal is processed or calculated by the controller 43. The required period of time and resulting frequency for the dithering control information may be calculated as follows:

$$\text{Period}_{dith}(t)=OT\times C^{(a(t)-atran)/65280}$$

where $\text{Period}_{dith}(t)$ is the sum of the desired (on time+off time) required for a given attenuation value a(t), OT is the pulse duration or on-time value stored in a look up table, C is contrast ratio defined as the ratio between the highest light output to the lowest light output as above, a(t) is the current output filter attenuation value represented by a number from 0 to 65280 and atran denotes the attenuation value at the transition point from constant current reduction approach to a dithering approach.

The formula for $\text{Period}_{dith}(t)$ includes an exponent term representing a constant value of '65280'. The constant '65280' is a product of the number of DMX dimming levels (255) excluding zero and a preferred filter gain of 256 (255×256=65280) which establishes a 16 bit value.

This constant is part of a digital attenuation filter with a gain of 256 whereby a maximum attenuation value a(t) of 65280 occurs when the dim command level is "0" or "off" and an attenuation level a(t) of "0" is considered 100% full intensity.

It is understood that the constant '65280' may be adjusted to an alternative constant value depending on a desired digital attenuation filter performance. For example, there may be a preference for a different range of attenuation values with an offset such that a filtered DMX dimming level of 0.5 is considered a minimum visible value, and a filtered DMX dimming level of 254.5 is considered a full intensity value of 100%. The scaled range will be (254.5−0.5)=254 and the resulting attenuation constant will be (254×256=65024).

This scale factor allows the attenuation filter to reach its final value more quickly since the filter will over shoot the range of attenuation such that anything below "0" attenuation is considered 100% full intensity and anything greater than 65024 will be considered "off".

The transition point attenuation value (atran) is held constant in dithering mode for a given LED load and electrical circuit design. It is understood that the transition point value is configurable for different LED load applications and/or electrical circuit characteristics.

The computation for period $Period_{dith}(t)$ is completed twice for two distinct on times (OT) and a dithering method with 4 bits of resolution gradually transitions between two on-time/period ratios and corresponding frequency bands in order to maintain a relatively narrow frequency band range.

FIG. 3 shows a sample table for a desired range of intensity values from 6.04% to 4.93%. with corresponding on-time/period pairs and weighting. In this example, over the upper intensity range, the constant DC current supplied to the load is reduced to a fixed constant current value of 33.3% of its full load value. At a dimming level value of 130 the table shows an on-time/period pair of (OT1/P1) 84/462 and (OT2/P2) of 70/386 with a calculated intensity value of 6.05%. The calculated intensity value is determined by the product of the combined duty cycle with both dithered frequency bands and weighting applied in this case 0.182 and the peak constant current point of 33.3%.

The dithered weighting for the OT1/P1 ratio at a dimming level of '130' is '7' and for the OT2/P2 ratio it is '9' meaning that the OT1/P1 ratio is utilized 7 out of 16 times and the OT2/P2 ratio is utilized 9 out of 16 times.

As the dim level changes based on commands from the external transmitter or data source to '129', the dithered weighting changes for OT1/P1 to 5 out of 16 times and OT2/P2 to 11 out of 16 times.

Any desired weighting may be implemented between OT/P pairs and corresponding frequency bands and dithering can also be implemented for more than two frequency bands. The on-times (OT1, OT2) are significantly different but the duty cycle (OT/P) for each pair is generally the same.

On-times (OT1, OT2 . . . OTn) are chosen to ensure multiple frequency bands may be utilized over the light intensity range where a dithered variable frequency method is implemented. The difference in on-time values for each OT/P pair for example OT1=84 μs and OT2=70 μs for a dim level of 130, is dependent on the desired number of frequency bands and desired contrast ratio (C). Each on-time (OT) is chosen to be a fixed multiple of the previous on-time, such that the requirements for contrast ratio (C) and number of desired variable frequency bands are met.

The table shown in FIG. 3, also shows the generation of intermediate light intensity levels by the attenuation filter between dimming level commands received from an external transmitter. For example, for a transition between dim level of '130' down to dim level of '129', three intermediate desired intensity levels (6.00%, 5.97%, 5.94%) are shown.

In one implementation, times are implemented using a counter that increments every 2 microseconds. The limitations of the counter require a rounding or truncation of the on-time to a multiple of the clock period in this instance, 2 microseconds. The result is that there may be some duplicate OT/P pairs generated between dimming command levels and subsequent intermediate desired light intensity levels. While not shown, this may be visible for attenuation values such as 32000, 32001, 32003, etc.

Figure 4:
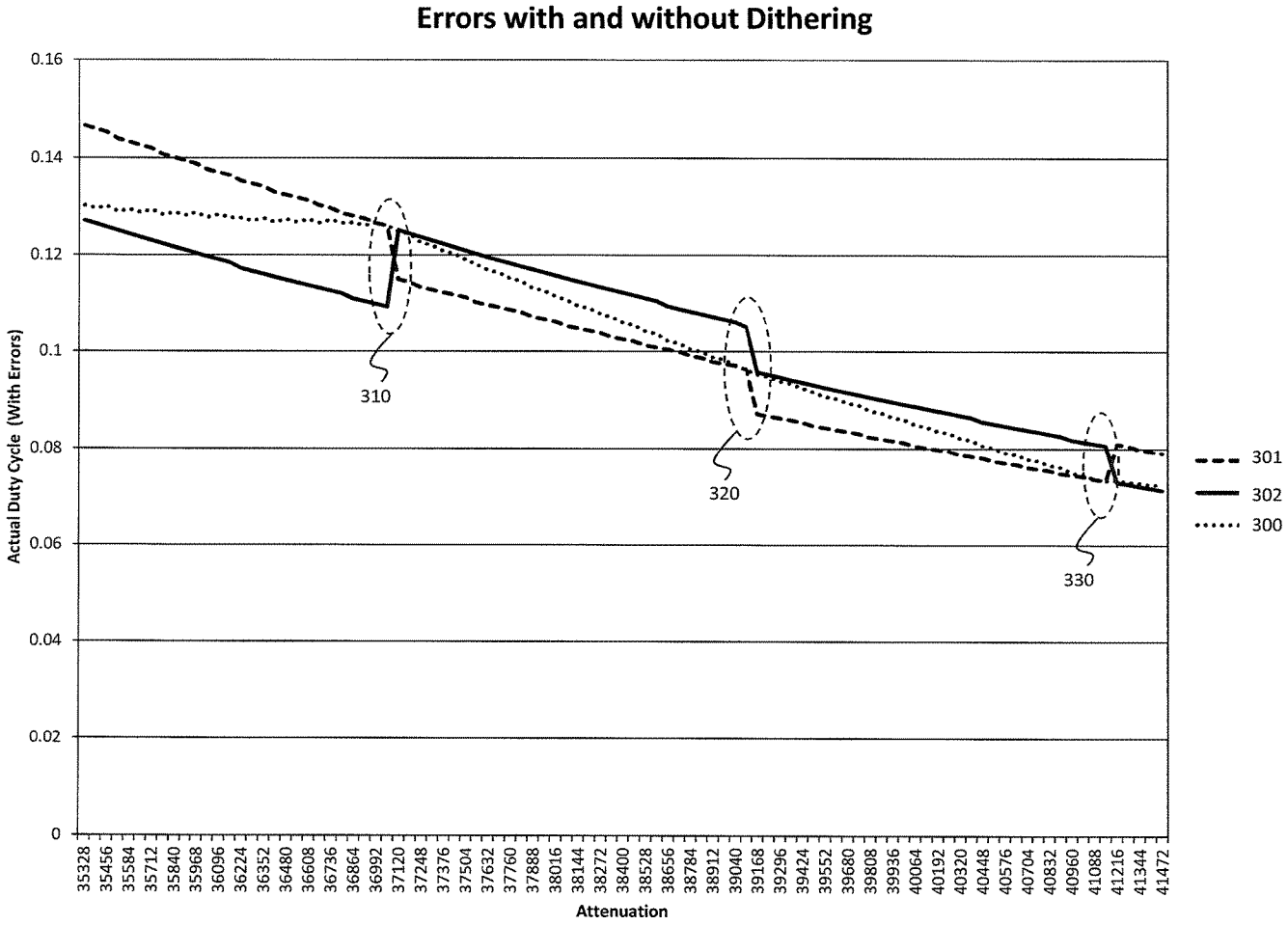
FIG. 4 is a graph showing a dithered light intensity response vs attenuation number.

FIG. 4 shows the effective dithered light intensity response curve 300 at relatively low light intensities and corresponding attenuation values. The graph also shows two non-dithered light intensity response curves (301 and 302) with distinct on-times. The y axis represents the actual duty cycle of each variable frequency band whereby 0.16 represents a duty cycle or on time of 16%. The x axis represents the attenuation value of the filter 47 shown in FIG. 1. In this embodiment, it can be seen that the transition point is configurable as the low light intensity range starts at a value higher than 10%.

The jumps or discontinuities 310, 320, 330 represent errors that occur when transitioning between different on-times and corresponding frequency bands as the light intensity changes with attenuation value via the dimming command.

Note that the effective light intensity response curve 300 has no significant discontinuities and shows a gradual change in attenuation to appear as a smooth transition.

Figure 6:
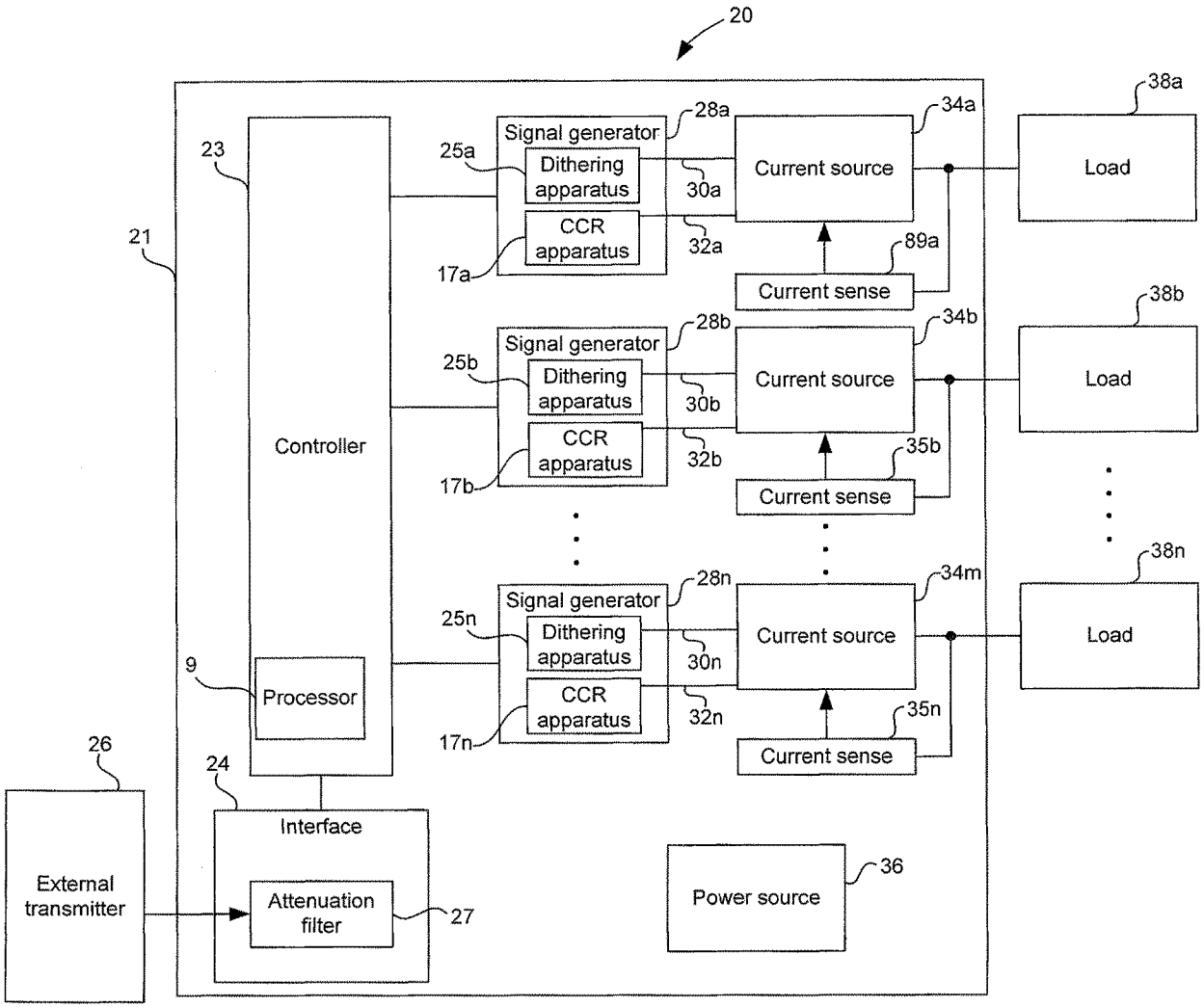
FIG. 6 is a schematic diagram of another embodiment of apparatus for controlling LEDs.

Turning to FIG. 6, a second embodiment of apparatus for controlling a load is shown. As with the embodiment of FIG. 1, the apparatus 20 includes an interface and optional attenuation filter 27 for communicating with an external transmitter 26 to receive dimming and/or color mixing information or command signals from the external transmitter. A controller 23, including a processor 9, for translating the dimming and color mixing information (or command signals) to LED/load control information receives the command signals and generates LED/load control information based on the command signals. The LED/load control information includes dithering control information and CCR control information.

The apparatus 20 further includes at least one signal generator 28 having apparatus for delivering a dithering control signal or CCR control signal, in the form of digital signal and analog signals, to at least one current source 34 that provides the necessary current to power an associated load 38. The current source 34 may also include an associated current sense 35. The dithering apparatus 25 and the CCR apparatus 17 perform similar functions to the dithering apparatus 51 and CCR apparatus 55 of FIG. 1 above.

Further, as with the embodiment of FIG. 1, the signal generator transmits a digital signal 30 and an analog signal 32 to the current source 34 which deliver the dithering control signal or the CCR control signal (depending on the command signal).

In this embodiment, the current source 34 includes a step down power converter with an independent current sense 35 connected to the positive voltage rail of the DC/DC power conversion circuit.

The DC/DC converter preferably also includes a LED driver IC (Integrated circuit) that provides a regulated current output by means of either a digital or analog control loop.

The LED driver IC further comprises 2 pins to receive the separate analog 30 and digital 32 control signals which together control the current provided by the current source 34 to its associated load 38.

Figure 5:
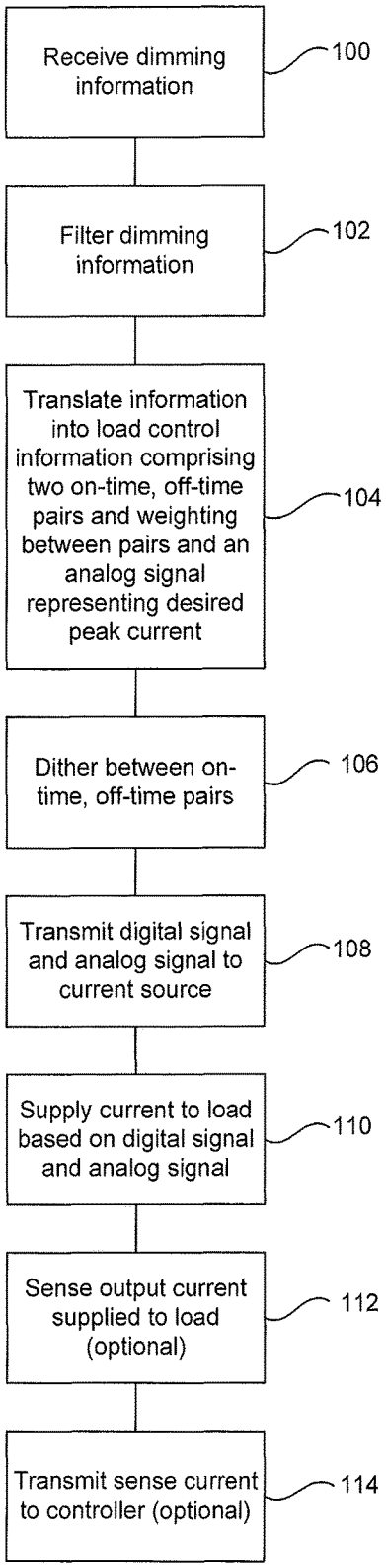
FIG. 5 is a flowchart outlining a method of controlling LEDs.

FIG. 5 is a flowchart outlining another embodiment of a method of controlling LEDs. In operation, to activate the system, the interface receives 100 dimming, or light intensity, information, seen as command signals, such as from an external transmitter. This dimming information may then be processed, or filtered 102, such as by the attenuation filter, if necessary. This processing may be performed either at the interface or in the controller depending on the requirements. For instance, if the information does not have to be filtered, it may be transmitted to the controller once it is received for processing by the controller. Alternatively, if filtering is required, the filtering of the information is performed by the interface before being transmitted to the controller. Once the controller receives the processed information, the controller translates 104 this information into LED/load control information. This LED/load control information includes dithering control information and CCR control information. For instance, with respect to the generation of the dithering control information, the LED/load control information may be translated into weighted on/off time pairs as well as a peak current level. The LED control information is translated 106 into dithering information which is transmitted 108 to the current source. Alternatively, the LED control information may be translated into information implementing the constant current reduction approach. The translation 106 is based on the light intensity level that is being controlled.

In 106, in one embodiment of the dithering approach, a signal generator is implemented by using the firmware of a controller or microcontroller to generate a sequence of digital logic level pulses of varying on and off times. These pulses are according to the on/off pairs and weighting ratio translated in 104, and thus implement a signal generator, such as one described in FIG. 1, with a dithering apparatus. Similarly with reference to FIG. 1, the analog control signal adjusts the DC current supplied to the load in constant current reduction mode and controls the peak on time current in dithering mode. Transmission 108 can be by direct electrical connection to the "Enable" or "Dim" line of a current source. The transmission includes an analog level for control of the peak current. In a digital conversion application, the sensed current signal may be used for closed loop control of the analog signal.

The current source then supplies 110 power to the LED load based on this LED control information, either based on the constant current reduction information or dithering information in order to control the LEDs as per the instructions from the external transmitter. The output current of the load may be sensed 112 and then transmitted 114 to the controller to provide feedback information associated with the powering of the LED loads. It will be understood that the sensing 112 and the transmitting 114 may not be implemented in all embodiments.

In dithering between variable frequency bands (as represented by the weighted on/off time pairs), when intensity is changed, the relative error introduced during the transition from one on-time to another is reduced. If multiple on-times, corresponding to multiple variable frequency bands are used, errors in the current pulse may cause the transition from one on-time to the next to exhibit a sharp change in intensity. If instead, the transition from one frequency band to the other is gradual, made by gradually changing the ratio of one frequency band to another frequency band, the average light intensity as sensed by the eye also changes gradually. FIG. 3 provides a table outlining gradual change in the ratio of one frequency band to the next with respect to intensity.

The introduction of the digital filter may reduce the size of intensity changes, by introducing smaller intermediate steps. For example, if instead of a single 2.5% jump in intensity, there are 5 increments of changes in intensity over the course of seconds, the change may not even be noticeable. While such a digital filter might be intuitive in other contexts, the DMX512A standard, which mandates exactly 255 levels, teaches against this.

In the preceding description, for purposes of explanation, numerous details are set forth in order to provide a thorough understanding of the embodiments of the disclosure. However, it will be apparent to one skilled in the art that these specific details are not required in order to practice the disclosure. In other instances, well-known electrical structures and circuits are shown in block diagram form in order not to obscure the disclosure. For example, specific details are not provided as to whether the embodiments of the disclosure described herein are implemented as a software routine, hardware circuit, firmware, or a combination thereof.

The above-described embodiments of the disclosure are intended to be examples only. Alterations, modifications and variations can be effected to the particular embodiments by those of skill in the art without departing from the scope of the disclosure.

What is claimed is:

1. A method for controlling solid state lighting comprising:

receiving dimming or light intensity information;

translating the dimming or light intensity information into LED control information; and transmitting the LED control information to a current source;

wherein the LED control information includes constant current reduction control information for a high light intensity range and dithering control information with variable frequency bands over a low light intensity range;

wherein the dithering control information comprises information associated with a transitioning between the variable frequency bands where an on time pulse duration is held constant and a period is varied for a portion of a dimming intensity range; and wherein the dithering control information comprises a first pair of on and off times, a second pair of on and off times and a ratio between the first and second pairs of on and off times, the ratio representing an amount of time the first pair of on and off times is used with respect to the second pair of on and off times.

2. The method of claim 1 wherein the high light intensity range is between about 10% to 100% light intensity.

3. The method of claim 2 wherein the low light intensity range is less than 10% light intensity.

4. The method of claim 3 wherein the low light intensity range is between 10% and 0.6 light intensity.

5. The method of claim 1 further comprising:

supplying power to a LED load based on the LED control information;

sensing output current of the LED load; and transmitting information associated with the sensed output current to a controller.

6. The method of claim 1 wherein a transition point between the high light intensity range and the low light intensity is configurable.

7. A method for controlling solid state lighting comprising:

implementing a dithering approach between variable frequency bands over a low light intensity range; and implementing a constant current reduction method over a high light intensity range;

whereby current is reduced without interruption over the high light intensity range, wherein the dithering approach comprises information associated with a transitioning between the variable frequency bands where an on time pulse duration is held constant and a period is varied for a portion of a dimming intensity range; and wherein the dithering approach comprises a first pair of on and off times, a second pair of on and off times and a ratio between the first and second pairs of on and off times, the ratio representing an amount of time the first pair of on and off times is used with respect to the second pair of on and off times.

8. The method of claim 7 wherein the dithering approach comprises:

maintaining a constant peak current while dithering between two variable frequency bands and corresponding variable periods with at least two distinct values of on time.

9. The method of claim 8 wherein the constant peak current is reduced from a value established at a full light intensity level by the constant current reduction method.

10. The method of claim 7 wherein the constant current reduction method comprises:

maintaining a digital signal in a constant signal state.

11. The method of claim 10 wherein the constant signal state is either active high or active low depending on digital logic implemented for the digital signal.

12. An apparatus for controlling solid state lighting comprising:

an interface for receiving command signals from an external source;

a controller for receiving the command signals and translating the command signals to LED control information, the LED control information implementing a constant current reduction approach over a high light intensity range and a dithering approach for variable frequency bands over a low light intensity range; and a set of signal generators for delivering the LED control information to a set of current sources to deliver power to the solid state lighting based on the LED control information;

wherein the dithering approach comprises information associated with a transitioning between the variable frequency bands where an on time pulse duration is held constant and a period is varied for a portion of a dimming intensity range; and wherein the dithering approach comprises a first pair of on and off times, a second pair of on and off times and a ratio between the first and second pairs of on and off times, the ratio representing an amount of time the first pair of on and off times is used with respect to the second pair of on and off times.

13. The apparatus of claim 12 wherein the external source is an external transmitter or a data source.

14. The apparatus of claim 13 wherein the interface comprises:

an attenuation filter.

15. The apparatus of claim 14 wherein the interface further comprises:

an analog-to-digital (A/D) converter.

16. The apparatus of claim 12 further comprising the set of current sources.

17. The apparatus of claim 16 wherein each of the set of current sources comprises:

a buck circuit power conversion stage with hysteretic control.

18. The apparatus of claim 12 wherein the set of signal generators transmit a digital signal and an analog signal to the set of current sources.

19. The apparatus of claim 17 wherein the buck conversion circuit includes a high side current sense.

* * * * *